US008006522B2

(12) United States Patent
Kim et al.

(10) Patent No.: US 8,006,522 B2
(45) Date of Patent: Aug. 30, 2011

(54) LIQUID DETERGENT DISPENSING SYSTEM FOR A WASHING MACHINE

(75) Inventors: Kyeong Hwan Kim, Seoul (KR); Il Hyeon Jo, Seoul (KR); Jin Ho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 601 days.

(21) Appl. No.: 12/037,376

(22) Filed: Feb. 26, 2008

(65) Prior Publication Data

US 2008/0202173 A1 Aug. 28, 2008

(30) Foreign Application Priority Data

Feb. 27, 2007 (KR) ..... 10-2007-0019724

(51) Int. Cl.
*D06F 29/00* (2006.01)
*D06F 35/00* (2006.01)

(52) U.S. Cl. ..... 68/17 R

(58) Field of Classification Search ..... 68/17 R
See application file for complete search history.

(56) References Cited

U.S. PATENT DOCUMENTS

| | | | | |
|---|---|---|---|---|
| 2,819,099 | A * | 1/1958 | Rittle | 277/626 |
| 6,058,743 | A | 5/2000 | Fujii et al. | |
| 2005/0172678 | A1 * | 8/2005 | Kim et al. | 68/3 R |
| 2005/0223503 | A1 | 10/2005 | Hong et al. | |
| 2006/0086155 | A1 | 4/2006 | Kim et al. | |
| 2006/0150687 | A1 | 7/2006 | Chang et al. | |
| 2006/0179584 | A1 | 8/2006 | Choi et al. | |
| 2006/0191301 | A1 | 8/2006 | Park et al. | |
| 2007/0001455 | A1 * | 1/2007 | Butler | 285/368 |
| 2007/0261177 | A1 * | 11/2007 | Risen et al. | 8/158 |
| 2009/0095331 | A1 * | 4/2009 | Hoppe | 134/99.2 |
| 2009/0095750 | A1 * | 4/2009 | Vitan et al. | 220/23.83 |
| 2010/0018259 | A1 * | 1/2010 | Jeong et al. | 68/17 R |

FOREIGN PATENT DOCUMENTS

| | | | |
|---|---|---|---|
| CN | 1746407 | A | 3/2006 |
| DE | 3238529 | A1 * | 4/1984 |
| DE | 3238529 | A1 | 4/1984 |
| DE | 3638109 | A1 | 5/1988 |
| EP | 0077463 | A2 | 4/1983 |
| EP | 77463 | A2 * | 4/1983 |
| EP | 104497 | A2 * | 4/1984 |
| EP | 0104497 | A2 | 4/1984 |
| WO | WO 9412716 | A1 * | 6/1994 |

OTHER PUBLICATIONS

DE 3238529 Machine Translation.*

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

A washing machine is provided. The washing machine includes a support frame, which supports the main housing of the washing machine, and a liquid detergent container, which is disposed in the support frame and contains a liquid detergent therein. Therefore, the washing machine can improve the efficiency of the use of a liquid detergent.

9 Claims, 5 Drawing Sheets

LIQUID DETERGENT DISPENSING SYSTEM FOR A WASHING MACHINE

This application claims priority from Korean Patent Application No. 10-2007-0019724 filed on Feb. 27, 2007 in the Korean Intellectual Property Office, the disclosure of which is incorporated herein by reference in its entirety.

BACKGROUND OF THE INVENTION

1. Field of the Invention

The present invention relates to a washing machine, and more particularly, to a washing machine which can improve the usability of a liquid detergent.

2. Description of the Related Art

In general, washing machines remove dust and dirt from clothing by performing a mechanical operation using water and a detergent. In recent years, washing machines have been equipped with a drier function for drying wet laundry with the use of a mechanical operation and hot wind generated by a heater.

Conventionally, users are required to put a liquid detergent into a washing machine whenever necessary for a washing operation, thereby causing inconvenience and reducing the efficiency of the use of a liquid detergent.

SUMMARY OF THE INVENTION

The present invention provides a washing machine which can improve the efficiency of the use of a liquid detergent.

According to an aspect of the present invention, there is provided a washing machine including a main housing; a tub which is disposed in the main housing; a support frame which supports the main housing; a liquid detergent container which is disposed in the support frame; a detergent supply unit into which wash water is injected and which supplies the wash water into the tub; and a liquid detergent supply path which guides a liquid detergent contained in the liquid detergent container into the detergent supply unit.

According to another aspect of the present invention, there is provided a washing machine including a main housing; a tub which is disposed in the main housing; a support frame which supports the main housing; a liquid detergent container which is disposed in the support frame; and a liquid detergent supply path which guides a liquid detergent contained from the liquid detergent container to the tub.

According to still another aspect of the present invention, there is provided a washing machine including a tub; a detergent supply unit configured to receive wash water and to supply the wash water to the tub; and a liquid detergent container configured to receive liquid detergent and to supply the liquid detergent to the detergent supply unit; wherein liquid detergent and wash water are mixed together in the detergent supply unit and supplied to the tub.

The washing machine may also include a liquid detergent supply pump which is disposed on the liquid detergent supply path and pumps the liquid detergent.

The liquid detergent supply pump may be disposed in the support frame.

A first end of the liquid detergent supply path may be connected to the liquid detergent container, and a second end of the liquid detergent supply path may pass through one surface of the support frame and one surface the main housing.

The second end of the liquid detergent supply path may pass through the top of the support frame and the bottom of the main housing.

The liquid detergent supply path may include a first supply path which has a first end connected to the liquid detergent container, a second supply path which has a first end connected to the tub or the detergent supply unit and at least one connector which connects the first supply path and the second supply path so as to be detachable from each other.

The at least one connector may include a first connector which is connected to a second end of the first supply path and a second connector which is connected to a second end of the second supply path, and the first connector and the second connector may be coupled to each other when the support frame is settled on the main housing.

The first connector may be inserted into a first through hole which is formed on the top of the support frame, and the second element may be inserted into a second through hole which is formed on the bottom of the main housing.

Therefore, the washing machine can improve the efficiency of the use of a liquid detergent.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

Figure 1:
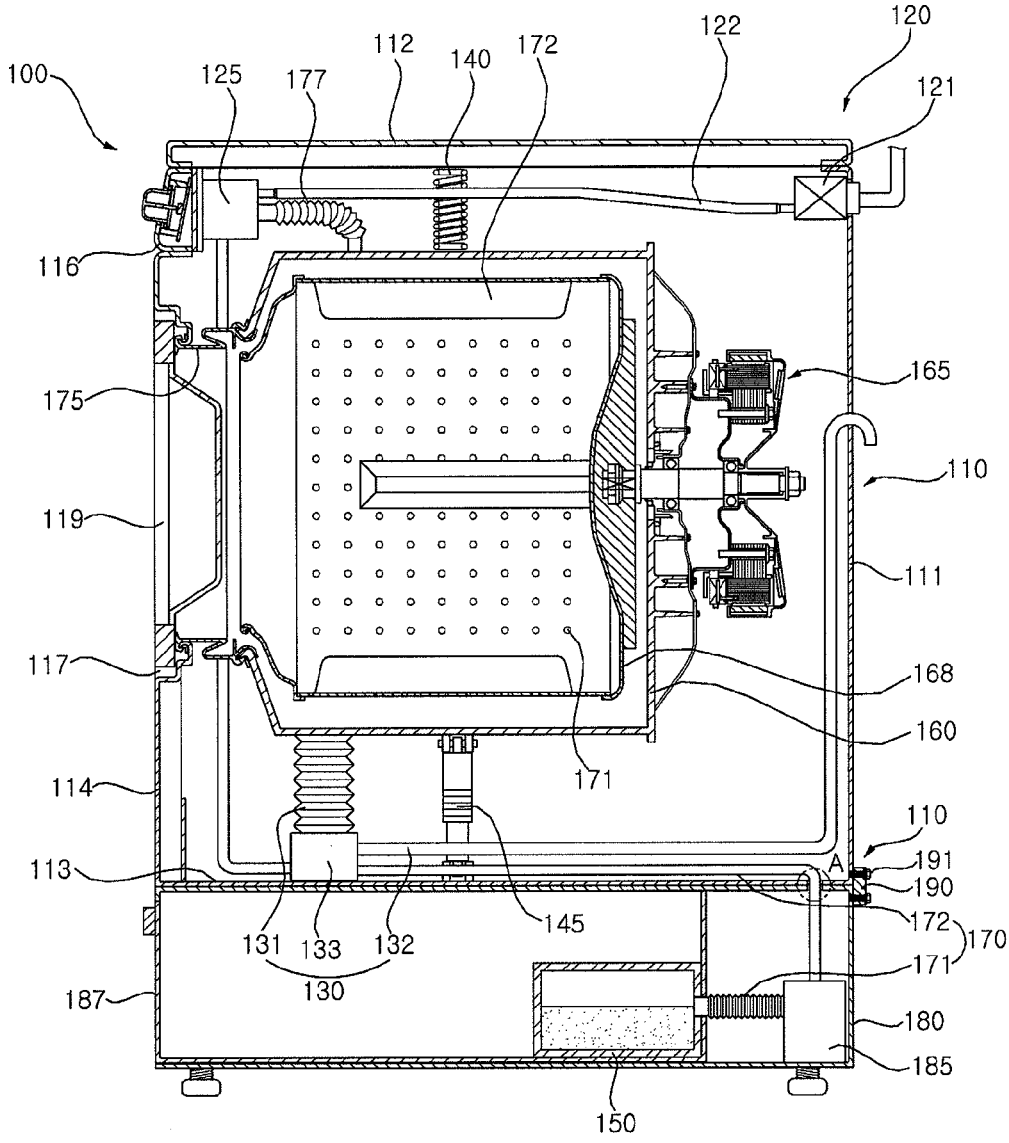
FIG. 1 illustrates a cross-sectional view of a drum-type washing machine according to an embodiment of the present invention.

FIG. 1 illustrates a cross-sectional view of a drum-type washing machine 100 according to an embodiment of the present invention. Referring to FIG. 1, the drum-type washing machine 100 includes a main housing 110 which defines an inner space of the drum-type washing machine 100. The main housing 110 includes a main housing unit 111 which defines the left, right and rear sides of the inner space of the drum-type washing machine 100; a cover unit 114 which defines a front side of the inner space of the drum-type washing machine 100; a top plate unit 112 which defines the top of the inner space of the drum-type washing machine 100; and a base unit 113 which defines the bottom of the inner space of the drum-type washing machine 100. An opening unit 117, through which laundry is inserted into the drum-type washing machine 100, is formed on the cover unit 114. A door 119 is installed so as to open up or close the opening unit 117.

The drum-type washing machine 100 may also include a tub 160 which is installed so as to be able to be buffered by a spring 140 and a damper 145 and to contain wash water; a drum 168 which is rotatably installed in the tub 160, can contain laundry and includes a plurality of water holes 171 through which wash water can pass; a lifter 172 which is disposed in the drum 168 and lifts laundry up and down in the drum 160; and a driving unit 165 which is disposed at the rear of the tub 160 and supplies rotation force to the drum 168. A control panel 116 is disposed at the front of an upper part of the drum-type washing machine 100. The control panel 116 may be used to control the operation of the drum-type washing machine 100. The drum-type washing machine 100 may also include a gasket 175 which is disposed between the door 119 and the tub 160. The gasket 175 may alleviate shock applied to the door 119 and prevent a leak of water during the rotation of the drum 1680.

The drum-type washing machine 100 may also include a support frame 180 which supports the main housing 110. The support frame 180 is disposed below the main housing 110. The main housing 110 and the support frame 180 may be connected to each other by a fixing element 190, which is disposed at the rear of the main housing 110 and the support frame 180. The fixing element 190 may be fixed to the rear of the main housing 110 and the rear of the support frame 180 by bolts 191. The bottom of the main housing 110 and the top of the support frame 180 may be fixed to each other by bolts. A lateral surface of the main housing 110 and a corresponding lateral surface of the support frame 180 may be fixed to each other by connectors such as bolts. The main housing 110 may simply be disposed on the support frame 180 without being fixed to the support frame 180. The present invention is not restricted to the above-mentioned arrangement of the main housing 110 and the support frame 180.

Figure 2:
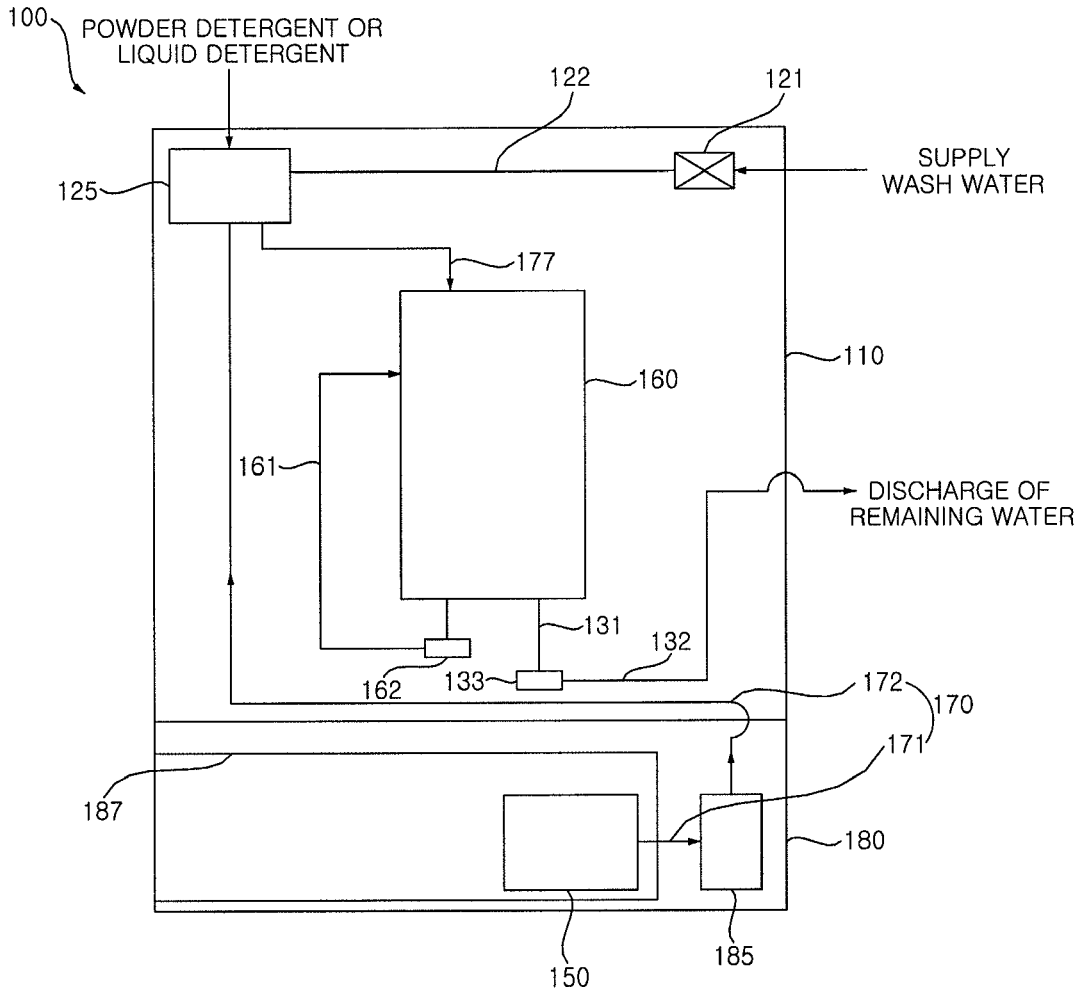
FIG. 2 illustrates a schematic diagram of the drum-type washing machine illustrated in FIG. 1.

FIG. 2 illustrates a schematic diagram of the drum-type washing machine 100 illustrated in FIG. 1. Referring to FIGS. 1 and 2, the drum-type washing machine 100 includes a drawer unit 187 which can be ejected from the support frame 180. The drawer unit 187 may be installed in the support frame 180 using a rail structure or a roller structure so as to slide in and out of the support frame 180. The drawer unit 187 has an open top, and a liquid detergent container 150 is disposed in the drawer unit 187. A liquid detergent may be contained in the liquid detergent container 150 in various manners. For example, a user may open the drawer unit 187 and put a liquid detergent in the liquid detergent container 150 through an injection hole (not shown) of the liquid detergent container 150. Alternatively, the user may open a door (not shown), which is disposed on one side of the support frame 180 and leads to the liquid detergent container 150, and then put a liquid detergent in the liquid detergent container 150. Still alternatively, a liquid detergent injection hole (not shown) that is connected to the liquid detergent container 150 may be disposed on the outside of the drawer unit 187, and then, the user may put a liquid detergent in the liquid detergent container 150 through the liquid detergent injection hole. However, the present invention is not restricted to those set forth herein. The number of liquid detergent containers 150 included in the drum-type washing machine 100 is not restricted to that set forth herein. That is, the drum-type washing machine 100 may include more than one liquid detergent container 150 if necessary. The size of the liquid detergent container 150 may vary.

Referring to FIGS. 1 and 2, the drum-type washing machine 100 may also include a circulation flow path 161 which connects one end to another end of the tub 160 and a circulation pump 162 which is disposed on the circulation flow path 161 and circulates wash water in the tub 160. The drum-type washing machine 100 may also include a drainer unit 130 which drains wash water from the tub 160. The drainer unit 130 includes a drain bellows tube 131 which is connected to the bottom of the tub 160, a drainage hose 132 which is connected to the drainage bellows tube 131 and guides water remained in the tub 160 to the outside of the drum-type washing machine 100, and a drainage pump 133 which is disposed between the drainage bellows tube 131 and the drainage hose 132. The drum-type washing machine 100 may also include a detergent supply unit 125 into which wash water is injected and which supplies the wash water into the tub 160. The detergent supply unit 125 is disposed in the main housing 110 of the drum-type washing machine 100. The detergent supply unit 125 includes a powder detergent container unit (not shown) which contains a powder detergent. Therefore, the drum-type washing machine 100 can use both a liquid detergent and a powder detergent.

Referring to FIGS. 1 and 2, the drum-type washing machine 100 may also include a wash water supply unit 120 through which wash water can be supplied into the tub 160 from the outside of the drum-type washing machine 100. The wash water supply unit 120 includes a wash water supply valve 121 and a wash water supply hose 122 which connects the wash water supply valve 121 and the detergent supply unit 125.

Referring to FIGS. 1 and 2, the drum-type washing machine 100 may also include a liquid detergent supply path 170 which connects the liquid detergent container 150 and the detergent supply unit 125, and a liquid detergent supply pump 185 which is disposed on the liquid detergent supply path 170 and supplies a liquid detergent contained in the liquid detergent container 150 to the detergent supply unit 125. More specifically, the liquid detergent supply pump 185 is disposed between the drawer unit 187 and a rear surface of the support frame 180. The liquid detergent supply path 170 is divided into a first liquid detergent supply path 171 which connects the liquid detergent container 150 and the liquid detergent supply pump 185 and a second liquid detergent supply path 172 which connects the liquid detergent supply pump 185 and the detergent supply unit 125. The first liquid detergent supply path 171 may have a variable length and thus enable the drawer unit 187 to be stably ejected from the support frame 180. Alternatively, the length of the first liquid detergent supply path 171 may be fixed, but sufficient to enable the drawer unit 187 to freely slide in and out of the support frame 180. However, the first liquid detergent supply path 171 is not restricted to the structures set forth herein.

Figure 3:
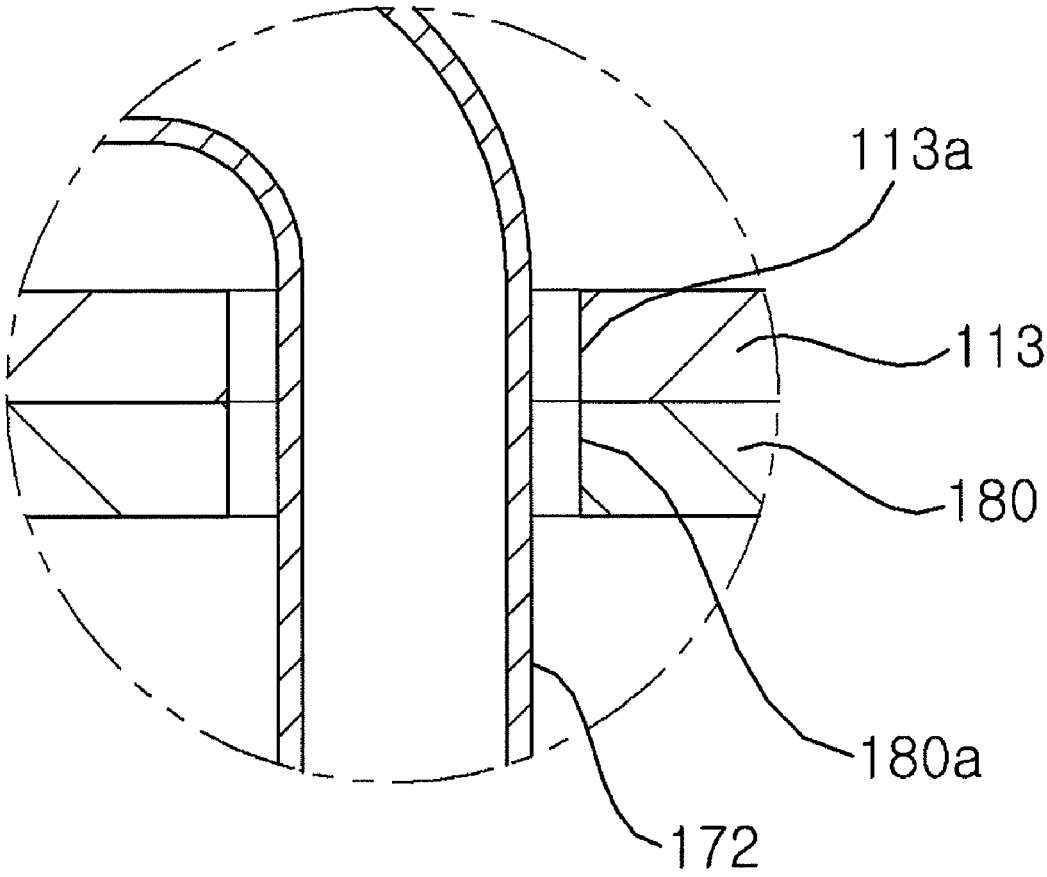
FIG. 3 illustrates an enlarged view of portion A of FIG. 1.

FIG. 3 illustrates an enlarged view of portion A of FIG. 1. Referring to FIG. 3, a first through hole **180*a* is formed on the top of the support frame 180, and a second through hole 113*a* is formed on the bottom of the base unit 113. Thus, a first end of the second liquid detergent supply path 172 is connected to an discharge line of the liquid detergent supply pump 185, and a second end of the second liquid detergent supply path 172 is connected to the detergent supply unit 125 through the first and second through holes 180*a* and 113*a*. In this manner, it is possible to simplify the structures of the support frame 180 and the base unit 113**.

The operation of the drum-type washing machine 100 will hereinafter be described in detail with reference to FIG. 2. When the drum-type washing machine 100 is turned on, the door 119 is opened, and laundry is inserted into the drum 168. Then, the drum-type washing machine 100 may automatically determine wash load incurred by the laundry. Alternatively, a user may input wash load to the drum-type washing machine 100 through the manipulation of the control panel 116. Once the wash load incurred by the laundry is determined, the drum-type washing machine 100 determines an amount of liquid detergent to be supplied and an amount of wash water to be supplied according to the wash load incurred by the laundry. The user may supply a powder detergent into the detergent supply unit 125. Thereafter, the liquid detergent supply pump 185 is driven and thus supplies the amount of liquid detergent determined by the drum-type washing machine 100 into the detergent supply unit 125. Thereafter, the amount of wash water determined by the drum-type washing machine is supplied into the detergent supply unit 125 through the wash water supply hose 122. Then, the wash water supplied into the detergent supply unit 125 is mixed with the liquid detergent supplied into the detergent supply unit 125, and the liquid detergent mixed with the wash water is supplied into the tub 160 through an ejection tube 177.

Figure 4:
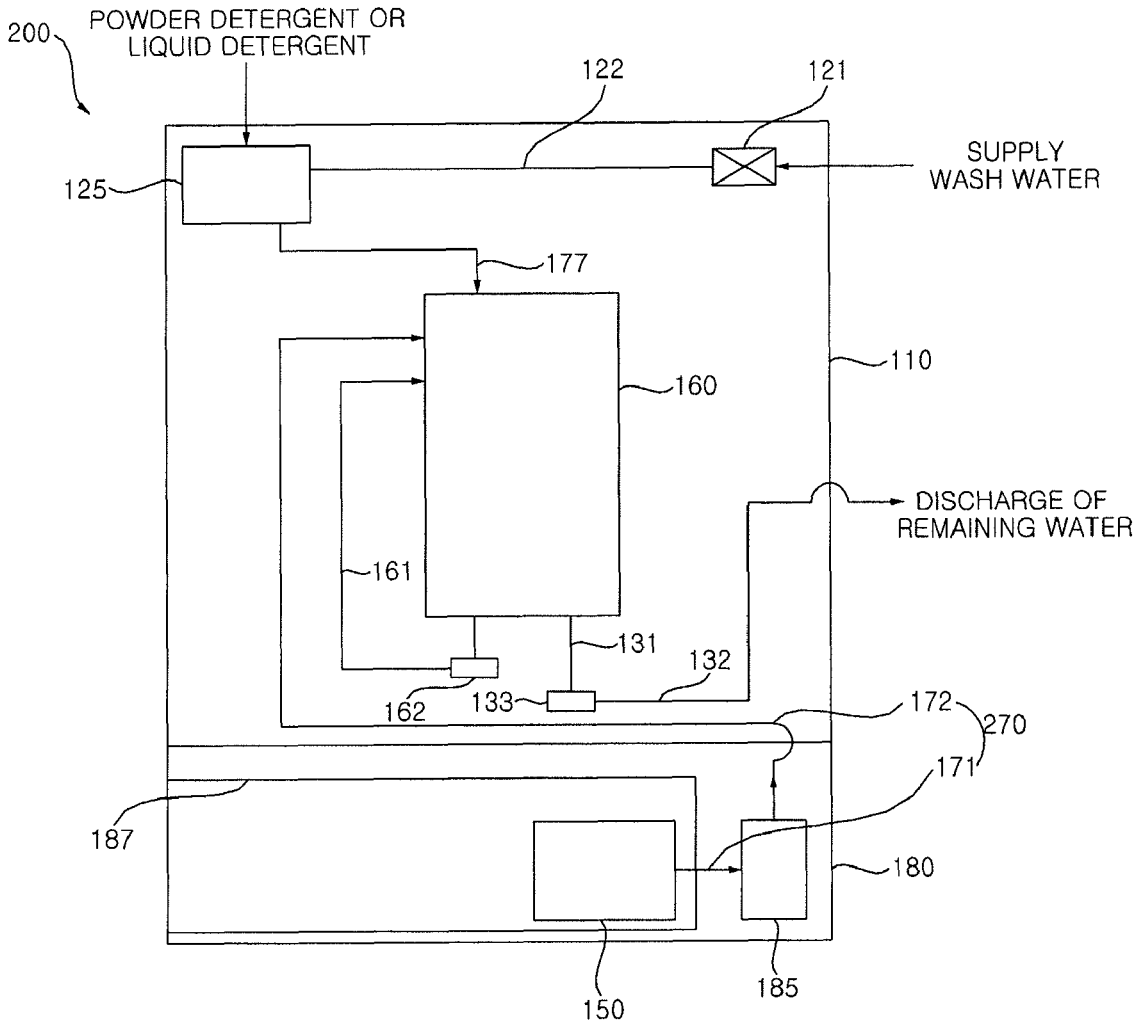
FIG. 4 illustrates a schematic diagram of a drum-type washing machine according to another embodiment of the present invention.

FIG. 4 illustrates a schematic diagram of a drum-type washing machine 200 according to another embodiment of the present invention. In FIGS. 1, 2 and 4, like reference numerals indicate like elements, and thus, detailed descriptions thereof will be skipped. The drum-type washing machine 200 will hereinafter be described, mainly focusing on the differences with the drum-type washing machine 100 of the embodiment of FIGS. 1 and 2.

Referring to FIG. 4, a liquid detergent supply path 270 connects a liquid detergent container 150 and a tub 160. In the embodiment of FIG. 2, a liquid detergent is supplied into the detergent supply unit 125 and then into the tub 160. On the other hand, in the embodiment of FIG. 4, a liquid detergent may be directly supplied into the tub 160. Therefore, the length of the liquid detergent supply path 270 may be shorter than the length of the liquid detergent supply path 170 in the embodiment of FIGS. 1 and 2, and the head difference between the liquid detergent container 150 and the position of the supply of a liquid detergent may decrease. Thus, it is possible to reduce the capacity of the liquid detergent supply pump 185. In addition, in the embodiment of FIG. 4, a wash water supply hose 122 may be directly connected to the tub 160. In this case, the detergent supply unit 125 in the embodiment of FIGS. 1 and 2 may be optional.

Figure 5:
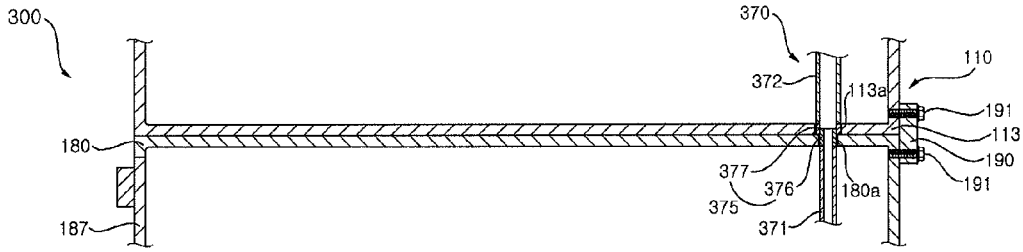
FIG. 5 illustrates a cross-sectional view of a drum-type washing machine according to another embodiment of the present invention.
Figure 6:
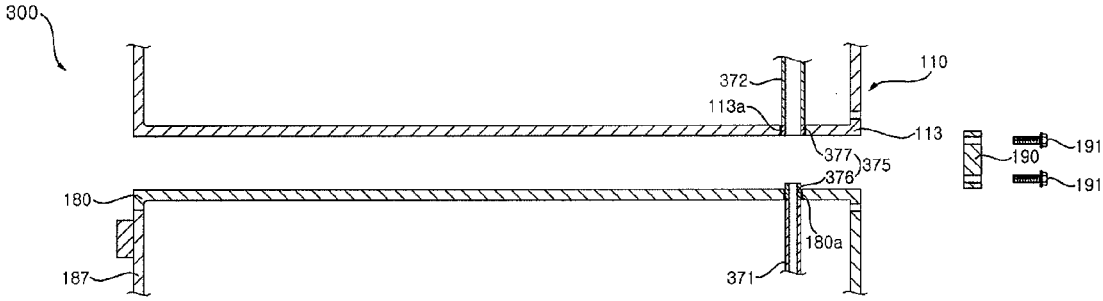
FIG. 6 illustrates an assembly view of a drum-type washing machine illustrated in FIG. 5.

FIGS. 5 and 6 illustrate schematic diagrams of a drum-type washing machine 300 according to another embodiment of the present invention. More specifically, FIG. 5 illustrates a partial cross-sectional view of the drum-type washing machine 300, and FIG. 6 illustrates a partial cross-section for explaining how to assemble the drum-type washing machine 300. In FIGS. 1 through 6, like reference numerals indicate like elements, and thus, detailed descriptions thereof will be skipped. The drum-type washing machine 300 has almost the same structure as the drum-type washing machine 100 illustrated in FIG. 1. Thus, the drum-type washing machine 300 will hereinafter be described, mainly focusing on the differences with the drum-type washing machine 100 illustrated in FIG. 1 and the drum-type washing machine 200 illustrated in FIG. 4.

Referring to FIG. 5, a first through hole 180*a* is formed on the top of a support frame 180, and a second through hole 113*a* is formed on the bottom of a base unit 113. A liquid detergent supply path 370 includes a first supply path 371, a second supply path 372 and a plurality of connectors 375. A first end of the first supply path 371 is connected to a liquid detergent container (not shown), and a second end of the first supply path 371 is connected to the first through hole 180*a*. A liquid detergent supply pump (not shown) into which a liquid detergent contained in a liquid detergent container (not shown) is injected is installed on the first supply path 371. A first end of the second supply path 372 is connected to a tub (not shown) or a detergent supply unit (not shown), and a second end of the second supply path 372 is connected to the second through hole 113*a*.

The connectors 375 include a first connector 376 which is coupled to the second end of the first supply path 371, and a second connector 377 which is coupled to the second end of the second supply path 372. The first connector 376 is inserted into the first through hole 180*a*, and the second connector 377 is inserted into the second through hole 113*a*. The inner diameter of the first connector 376 is less than the inner diameter of the second connector 377, and thus, the first connector 376 may be inserted into the second connector 377. Since the first connector 376 has elasticity, the first connector 376 may be inserted into the second connector 377 so that the space between the first connector 377 and the second connector 377 can be hermitically sealed. A sealing element (not shown) may be additionally provided between the first connector 376 and the second connector 377 in order to further seal the space between the first connector 376 and the second connector 377. The connectors 375 are not restricted to the structure set forth herein as long as the first connector 377 and the second connector 377 can be attached to/detached from each other.

Referring to FIG. 6, when a main housing 110 is settled on a support frame 180, the first connector 376 and the second connector 377 are automatically coupled to each other, and thus, there is no need to additionally connect the first supply path and the second supply path.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid detergent dispensing system for a washing machine comprising:

a main housing;

a tub disposed in the main housing;

a support frame configured to support the main housing;

a liquid detergent container disposed in the support frame;

a detergent supply unit configured to receive wash water therein and to supply the wash water to the tub; and a liquid detergent supply path configured to guide a liquid detergent from the liquid detergent container to any one of the detergent supply unit and the tub, wherein the liquid detergent supply path includes a first supply path having a first end connected to the liquid detergent container and a second supply path having a first end connected to the detergent supply unit, and wherein a first connector is inserted into a first through hole formed at a top surface of the support frame to be connected to a second end of the first supply path and a second connector is inserted into a second through hole formed at the bottom of the main housing to be connected to a second end of the second supply path, the first connector and second connector being coupled to each other when the main housing is supported on the support frame.

2. The liquid detergent dispensing system of claim 1, further comprising a liquid detergent supply pump disposed on the liquid detergent supply path and configured to pump the liquid detergent.

3. The liquid detergent dispensing system of claim 2, wherein the liquid detergent supply pump is disposed in the support frame.

4. The liquid detergent dispensing system of claim 1, wherein the detergent supply unit comprises a powder detergent container configured to receive powder detergent therein, the powder detergent in the powder detergent container being mixed with the wash water, and then supplied to the tub.

5. A liquid detergent dispensing system for a washing machine comprising:

a main housing;

a tub disposed in the main housing;

a support frame configured to support the main housing and disposed below the main housing;

a liquid detergent container disposed in the support frame; and a liquid detergent supply path configured to guide liquid detergent from the liquid detergent container to the tub, wherein the liquid detergent container is disposed in a drawer slidably installed in the support frame, and wherein the liquid detergent supply path comprises a first supply path having a first end connected to the liquid detergent container, a second supply path having a first end connected to the tub and at least one connector configured to detachably connect the first supply path and the second supply path.

6. The liquid detergent dispensing system of claim 5, further comprising a liquid detergent supply pump disposed on the liquid detergent supply path and configured to pump the liquid detergent.

7. The liquid detergent dispensing system of claim 5, wherein the liquid detergent supply pump is disposed in the support frame.

8. The liquid detergent dispensing system of claim 5, wherein the at least one connector comprises a first connector connected to a second end of the first supply path and a second connector connected to a second end of the second supply path, the first connector and the second connector being coupled to each other when the main housing is supported on the support frame.

9. The liquid detergent dispensing system of claim 8, wherein the first connector is inserted into a first through hole formed on a top of the support frame, and the second connector is inserted into a second through hole formed on a bottom of the main housing.

* * * * *